US005770839A

United States Patent [19]

Ruebush et al.

[11] Patent Number: 5,770,839

[45] Date of Patent: Jun. 23, 1998

[54] MICROWAVEABLE BAG FOR COOKING AND SERVING FOOD

[75] Inventors: Richard P. Ruebush, Campobello; P. Elaine Danis; Dennis A. Olsheski, both of Moore, all of S.C.

[73] Assignee: Union Camp Corporation, Lawrenceville, N.J.

[21] Appl. No.: 666,895

[22] Filed: Jun. 20, 1996

[51] Int. Cl.[6] ..... H05B 6/80

[52] U.S. Cl. ..... 219/727; 219/730; 219/735; 426/234; 99/DIG. 14

[58] Field of Search ..... 219/725, 727, 219/730, 732, 734, 735; 426/107, 113, 118, 234, 243; 99/DIG. 14

[56] References Cited

U.S. PATENT DOCUMENTS

| | | | |
|---|---|---|---|
| 2,041,227 | 5/1936 | Chalmers . | |
| 2,149,872 | 3/1939 | Schmidt . | |
| 2,865,768 | 12/1958 | Barnes et al. | 426/111 |
| 3,023,947 | 3/1962 | McDuffie . | |
| 3,027,261 | 3/1962 | Samara . | |
| 3,052,554 | 9/1962 | Colman . | |

(List continued on next page.)

OTHER PUBLICATIONS

MacBerry, Zipper Top Tab, Jan. 15, 1990, Kannapolis, N.C.

*Primary Examiner*—Philip H. Leung
*Attorney, Agent, or Firm*—Dennis H. Lambert

[57] ABSTRACT

A container for storing and cooking food, especially microwave cooking of popcorn, and for use as a container in which to serve the popcorn after it is popped. The container of the invention comprises a bag having front and back panels that define a cooking chamber between them, and a fold-over flap that projects from the back panel and defines an expansion chamber in communication with the cooking chamber. A microwave susceptor is provided in the front panel to absorb microwave energy during microwave cooking to heat and cook the popcorn in the cooking chamber, and as the popcorn expands during the popping cycle, the cooking and expansion chambers expand to form a single large interior volume for containing the popped popcorn. The front and back panels and the fold-over flap define a tripartite structure which is folded flat during shipment and storage, and which is placed flat on the front panel when it is desired to pop the popcorn. During and at the conclusion of the popping cycle, the fold-over flap projects upwardly from the back panel, and the chamber defined by it is oriented at the upper surface of the bag. A frangible strip is provided at an upper free edge of the fold-over flap, and this strip is openable at the end of the popping cycle to provide a wide opening at the top surface of the bag for access to the popped popcorn. The front panel defines a wide, stable support for supporting the bag with the open side disposed upwardly, whereby the bag is especially suitable as a container from which to serve the popped popcorn.

10 Claims, 7 Drawing Sheets

U.S. PATENT DOCUMENTS 3,143,277 8/1964 Fleur .
3,286,832 11/1966 Pilger .
3,293,048 12/1966 Kitterman .
3,381,886 5/1968 Goglio .
3,637,132 1/1972 Gray .
3,835,280 9/1974 Gades et al. .
3,851,574 12/1974 Katz et al. .
3,873,735 3/1975 Chalin et al. .
3,970,241 7/1976 Hanson .
3,973,045 8/1976 Brandberg et al. .
3,987,959 10/1976 Deards et al. .
4,038,425 7/1977 Brandberg et al. .
4,165,832 8/1979 Kuklies et al. .
4,219,573 8/1980 Borek .
4,358,466 11/1982 Stevenson ..... 426/118
4,450,180 5/1984 Watkins .
4,553,010 11/1985 Bohrer et al. .
4,554,192 11/1985 Benoit .
4,588,392 5/1986 Maddock .
4,597,103 6/1986 Hoover .
4,676,378 6/1987 Baxley et al. .
4,691,374 9/1987 Watkins et al. .
4,720,872 1/1988 Kaczerwaski .
4,735,513 4/1988 Watkins et al. .
4,835,037 5/1989 Beer .
4,878,765 11/1989 Watkins et al. .
4,892,744 1/1990 Ylvisaker .
4,904,093 2/1990 Woods et al. .
4,904,488 2/1990 Labaw et al. .
4,927,648 5/1990 Ylvisaker .
4,937,410 6/1990 Anderson .
4,950,859 8/1990 Anderson ..... 219/727
4,973,810 11/1990 Brauner .
5,011,299 4/1991 Black, Jr. et al. .
5,044,777 9/1991 Watkins et al. .
5,165,799 11/1992 Wood .
5,189,272 2/1993 McDonald et al. .
5,195,829 3/1993 Watkins et al. .
5,317,118 5/1994 Brandberg et al. .
5,326,576 7/1994 Zuege .
5,435,648 7/1995 Berkoff ..... 383/90
5,464,969 11/1995 Miller ..... 219/735
5,488,220 1/1996 Freerks et al. .
5,622,432 4/1997 Zicker ..... 383/210

FIG. 7
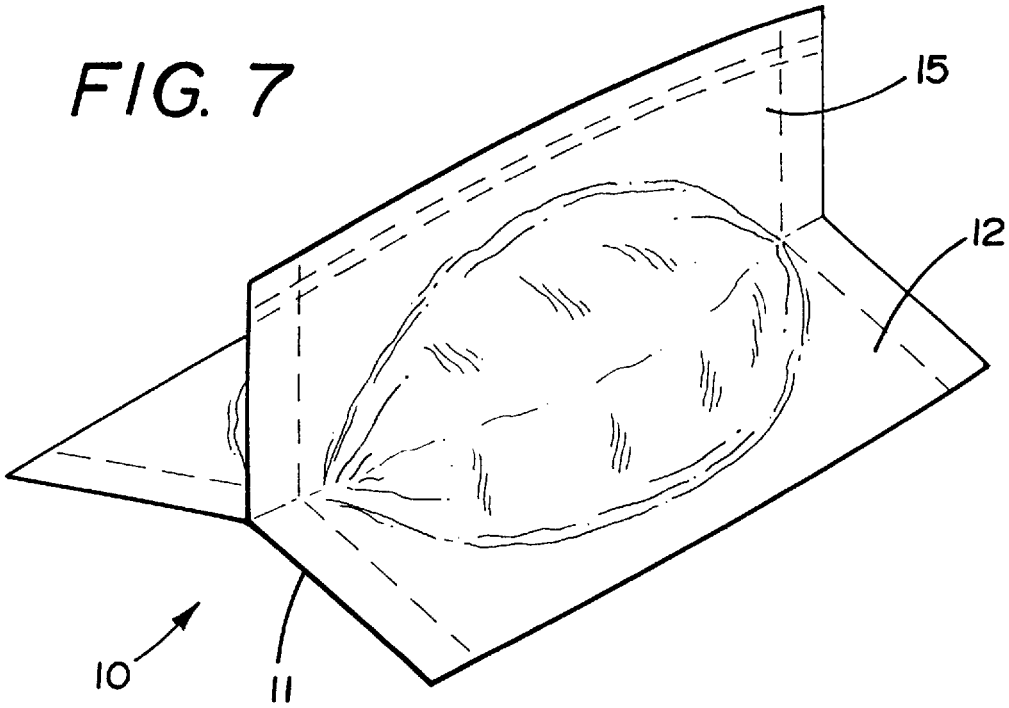
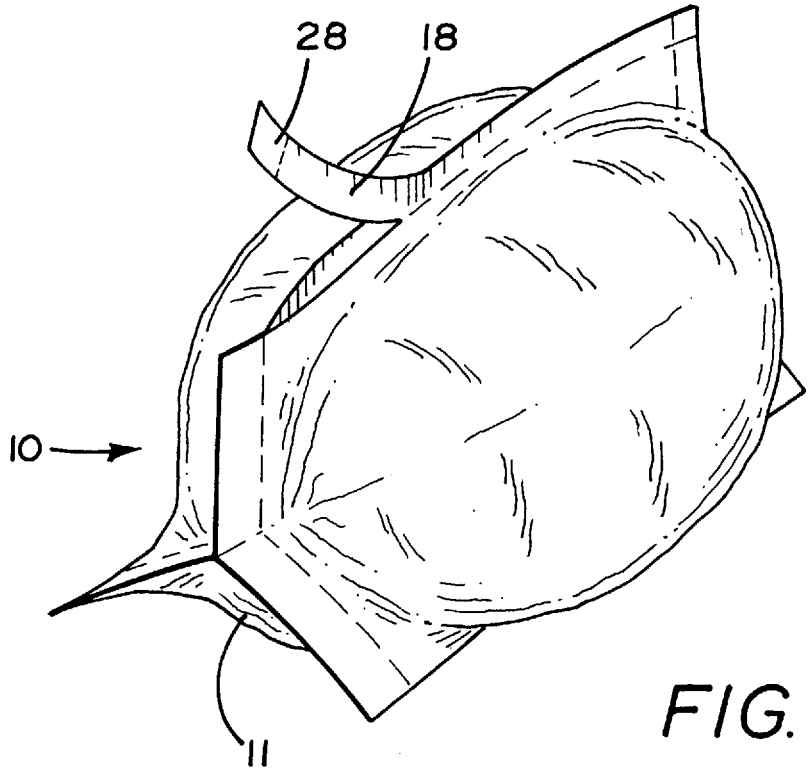
FIG. 8

FIG. 12
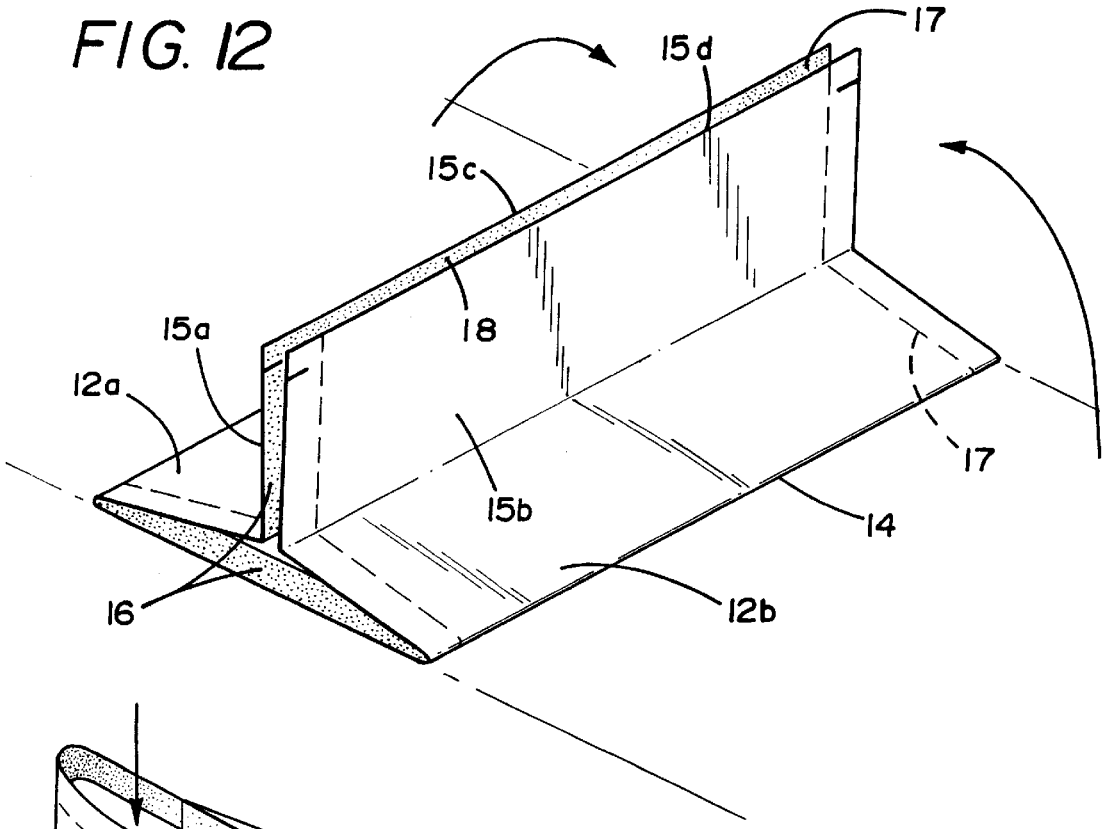
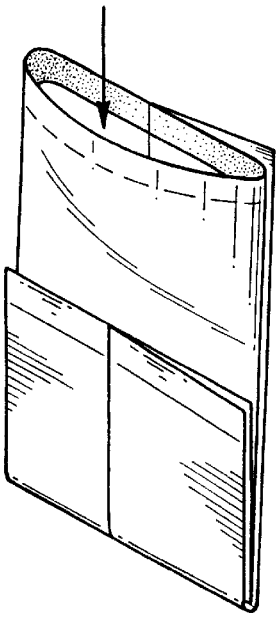
FIG. 14
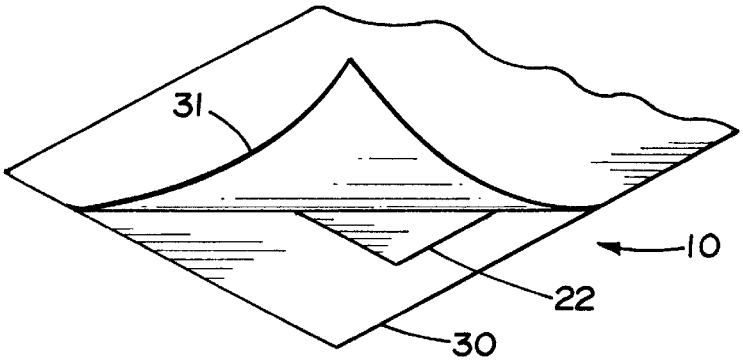
FIG. 13

MICROWAVEABLE BAG FOR COOKING AND SERVING FOOD

BACKGROUND OF THE INVENTION

1. Field of the Invention

This invention relates in general to containers for storing and cooking food. More particularly, the invention relates to a container for receiving, storing and cooking food in a microwave oven, wherein the container is configured to function as a means for serving the food after it is cooked.

2. Description of the Prior Art

A variety of containers are known in the prior art for receiving, storing and cooking food. Containers for storing and cooking food are particularly well suited for microwave cooking, and include microwavable bags for popping popcorn. Such bags typically have front and back panels joined by gusseted side panels, and a microwave susceptor in one panel for absorbing microwave energy and heating the contents of the bag. The gusseted side panels enable the bag to be folded flat for storage and shipment, but unfold and enable the bag to expand when the popcorn inside the bag is cooked. Examples of these bags are described in applicant's earlier U.S. Pat. No. 5,488,220, issued Jan. 30, 1996, and in U.S. Pat. Nos. 5,044,777 and 5,326,576. The bags described in these patents all have gusseted side panels and opposite closed ends, and are especially concerned with the placement and construction of adhesive closure means at the opposite ends and gusseted side panels, to provide bags which improve the ease of filling them with popcorn to be popped and/or which improve the yield of popped popcorn by insuring that all or substantially all of the popcorn kernels are exposed to the heat source.

Other examples of packages or containers for storing and cooking food are described in U.S. Pat. Nos. 3,052,554, 4,038,425, 4,553,010, 4,892,744, 4,904,093, 4,927,648, 4,937,410 and 5,503,477. All except one (U.S. Pat. No. 3,052,554) of these prior art containers are intended or suitable for use in microwave cooking, and all except one (U.S. Pat. No. 4,904,093) are particularly adapted for popping popcorn.

U.S. Pat. No. 3,052,554, although used for popping popcorn, is designed for use on an external heat source such as a stove, and does not rely upon microwave energy for cooking the popcorn. The container described in this patent is openable on one side to define a bowl-like container which is suitable for functioning as a container from which to serve the popcorn, but it is constructed of laminated foil sheets and is placed in a pan or skillet to heat and pop the popcorn confined between the foil sheets. One of the foil sheets can then be ripped or torn open to gain access to the popped popcorn.

U.S. Pat. No. 4,904,093 also is openable along one side to gain access to the cooked food, and is reusable, if desired. The container in this patent is constructed of flexible thermoplastic material and is directed to improved reinforcement for the gusset regions.

The remaining patents are all either open at one end or are openable at one end after the food is cooked to gain access to the cooked food, and with the exception of the container described in U.S. Pat. No. 3,052,554, none of the containers described in the foregoing patents are particularly suited for functioning as containers from which to serve the cooked food. Instead, it is generally necessary to empty the contents into a separate container from which the food may be served. Moreover, conventional bags for microwave cooking usually vent through an end of the bag, with the result that there is potential for leakage of cooking oil from the bag during use of it. Further, conventional bags are configured to be opened at one end for access to the cooked food. This presents a small opening through which it is relatively difficult to retrieve the cooked food, and the container is not capable of stable support on its other, closed end, whereby it is usually necessary to empty the cooked food into another container in which to serve the food for consumption.

Accordingly, there is need for a simple and inexpensive container for storing and cooking food in a microwave oven, wherein the container is especially adapted to function as a means in which to serve the food after it is cooked.

SUMMARY OF THE INVENTION

In accordance with the present invention, a simple and inexpensive container is uniquely configured to enable it to be used for microwave cooking of food and then opened along one side to define a bowl-like container from which the cooked food may be served.

The container of the invention comprises a bag having front and back panels that define a cooking chamber between them, and a fold-over flap that projects from the back panel and defines an expansion chamber in communication with the cooking chamber. A microwave susceptor is provided in the front panel to absorb microwave energy during microwave cooking to heat and cook the popcorn in the cooking chamber, and as the popcorn expands during the popping cycle, the cooking and expansion chambers expand to form a single large interior volume for containing the popped popcorn. The front and back panels and the fold-over flap define a tripartite structure which is folded flat during shipment and storage, as seen in FIG. 1, and which is placed flat on the front panel when it is desired to pop the popcorn. During and at the conclusion of the popping cycle, the fold-over flap projects upwardly from the back panel, as seen in FIG. 2, and the chamber defined by it is oriented at the upper surface of the bag. A frangible strip is provided at an upper free edge of the fold-over flap, and this strip is openable at the end of the popping cycle to provide a wide opening at the top surface of the bag for access to the popped popcorn. The front panel defines a wide, stable support for supporting the bag with the open side disposed upwardly, whereby the bag is especially suitable as a container from which to serve the popped popcorn. Further, because the bag has no gussets, it expands easier during the pop cycle and also the popcorn kernels cannot get trapped in gusset corners, as they can in conventional, gusseted bags. Thus, more complete popping of the kernels can be achieved with the bag of the invention than with conventional, gusseted bags, which enable kernels to become trapped in the gusset corners, away from the microwave susceptor patch.

More specifically, the container of the invention comprises an elongate bag defined by rectangularly shaped front and back panels joined at their opposite longitudinal side edges by longitudinally extending fold lines. The microwave susceptor in the front panel is disposed beneath the cooking chamber so that the food being cooked tends to migrate toward it under the influence of gravity. The back panel is defined by two half portions or sections extending inwardly from the respective fold lines at opposite side edges of the bag. These half sections terminate at their inner edges in a pair of panels that define the fold-over flap, which extends the length of the back panel substantially along its longitudinal centerline. The fold-over flap has a width substantially equal to one half the width of the back panel, and when folded over it lies flat against the back panel from substantially the center line thereof to one of the side edges.

Opposite ends of the front and back panels and the fold-over flap are secured together by suitable closure means, such as an adhesive, and the outer longitudinal edges of the panels defining the fold-over flap are also secured together by suitable closure means, such as an adhesive, to define a longitudinal seam at the outer edge of the fold-over flap. This longitudinal seam functions to vent the bag during cooking of the food, and means is provided along this edge to enable it to be opened for gaining access to the contents of the bag after the food is cooked.

The bag is manufactured from a single flat sheet which may have inner and outer plies laminated together and then folded to define the structure described above, with the microwave susceptor sandwiched between the laminated plies. Suitable graphics and the bands of adhesive to seal the opposite ends and longitudinal seam are applied to the sheet before it is folded.

During manufacture of the bag, one end is left unsealed. Following manufacture of the bag, and prior to filling it with the food to be cooked, the bag is shipped in its flattened or collapsed condition to a suitable facility for filling the bag with food to be cooked. Prior to placing the food in the bag, approximately one-third of the length of the bag at the closed bottom end (see FIG. 14) is folded into overlying relationship with the central body portion of the bag. Following filling of the bag, the top end is closed and sealed and then folded over to retain the food in the central portion of the bag adjacent the heat enhancer. Reference may be made to FIGS. 6, 7 and 10 in U.S. Pat. No. 5,326,576, to Zuege, which illustrates typical steps during the manufacturing process.

At the point of use, the package is placed face down in a microwave oven, and as the food cooks it expands and causes the bag to expand outwardly, opening up the cooking chamber and expansion chamber to define the single interior volume into which the cooked food expands as it is cooked. The container expands into a unique tripartite shape that results in a free-standing package with the longitudinal seam of the fold-over flap extending along the top surface. Following cooking of the food, this seam can be conveniently opened wide to allow easy access to the food inside the package. Further, because vent opening does not occur at either end closure of the bag during the cooking cycle, hot oils do not seep out of the container. This reduces oil contamination on the oven floor and on the hands or clothing of a person using the container of the invention. The filled container of the invention will sit up conveniently on a table or in a person's lap and will not fall or tip over easily, thereby avoiding spillage of the popcorn from the container. Food, e.g., popcorn, can be eaten directly from the container without the need to hold the container in an upright position or to empty the popcorn into another container. Further, because the bag has no gussets, it expands easier during the pop cycle and also the popcorn kernels cannot get trapped in the gusset corners of the bag.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 7 is a top perspective view of the bag of FIG. 6, showing it partially expanded and in the position it would assume during a cooking cycle;

FIG. 8 is a top perspective view of the bag of FIG. 7, showing it fully expanded following cooking of the food therein, and depicting the seam along the top edge of the fold-over flap being removed to open the bag;

FIG. 12 is a top perspective view of the blank of FIG. 11, showing it being folded inwardly from its opposite side edges to form the back panel and fold-over flap;

FIG. 13 is a fragmentary top perspective view of a portion of the blank of FIG. 10, illustrating the inner and outer plies and the microwave susceptor sandwiched therebetween; and FIG. 14 is a top perspective view of the bag of the invention, shown in the position it might be placed during filling of the bag with food to be cooked.

DETAILED DESCRIPTION OF THE PREFERRED EMBODIMENTS

Figure 1:
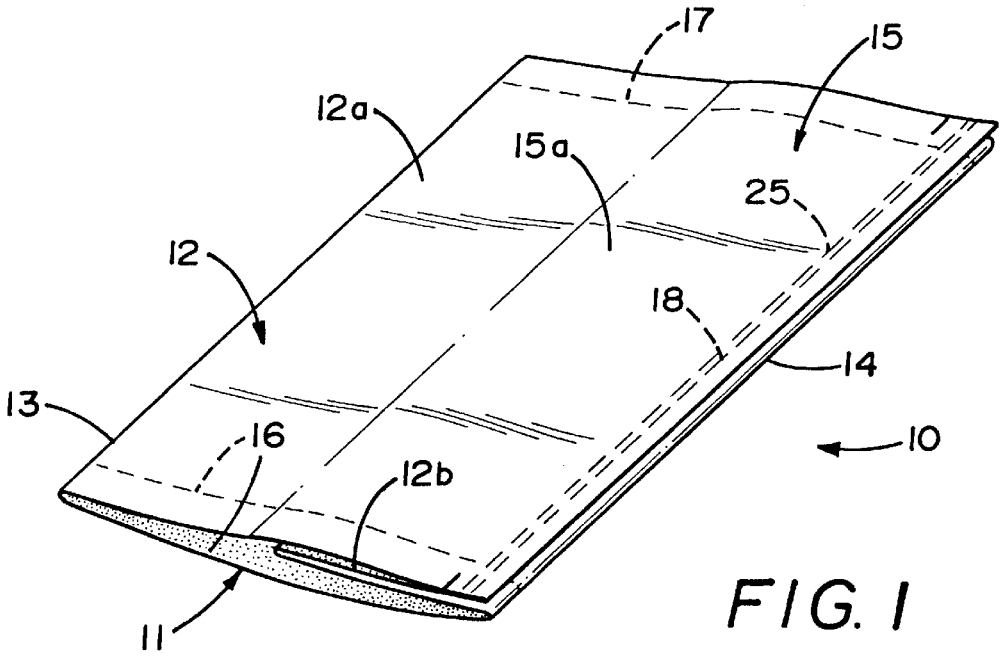
FIG. 1 is a top perspective view of the bag of the invention, shown in its as-manufactured condition prior to being filled with food to be cooked.
Figure 2:
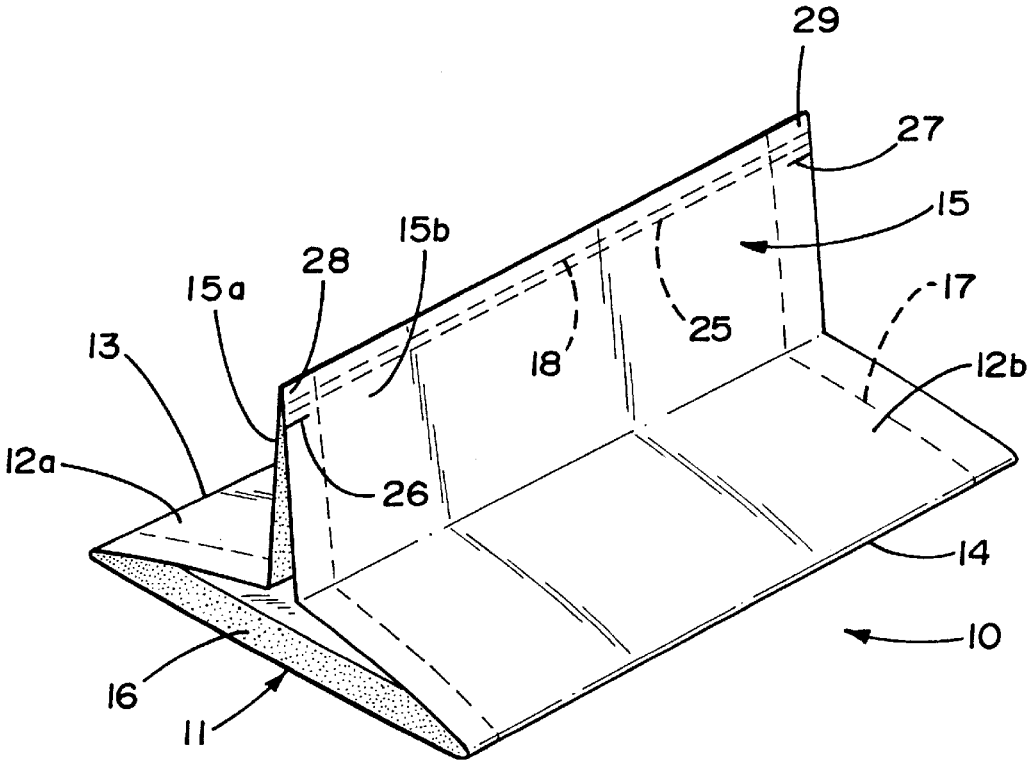
FIG. 2 is a top perspective of the bag of FIG. 1, with the fold-over flap shown in an upright, outwardly extended position.
Figure 3:
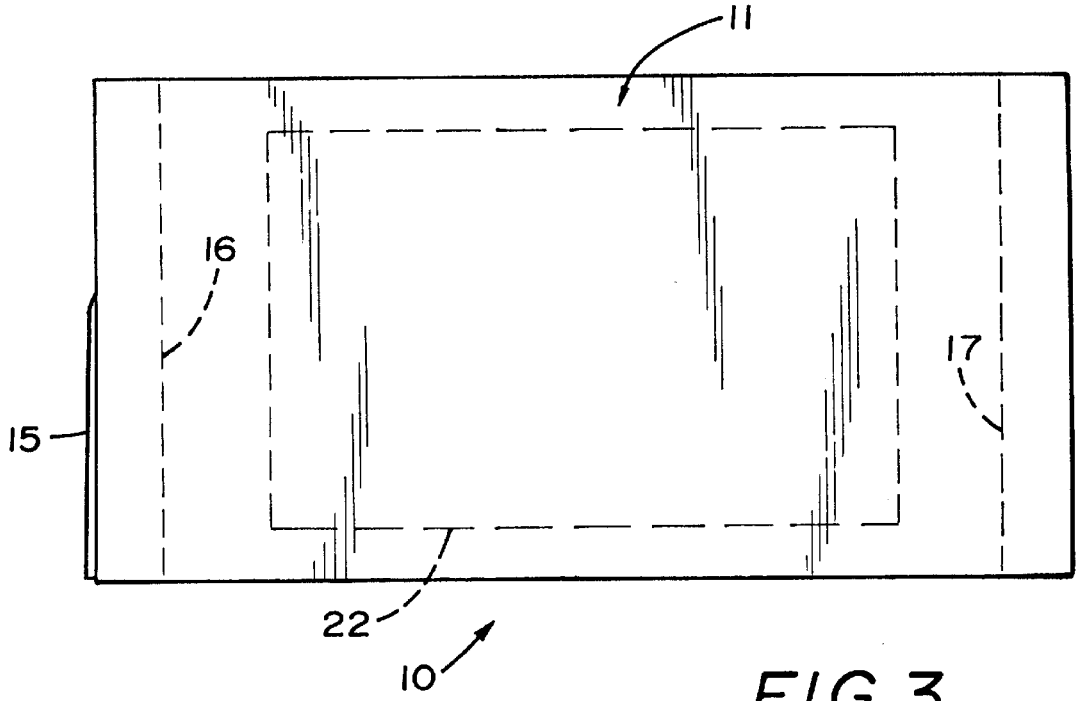
FIG. 3 is a bottom or front plan view of the bag of the invention, showing in dashed lines the location of the microwave susceptor in the front panel of the bag.
Figure 4:
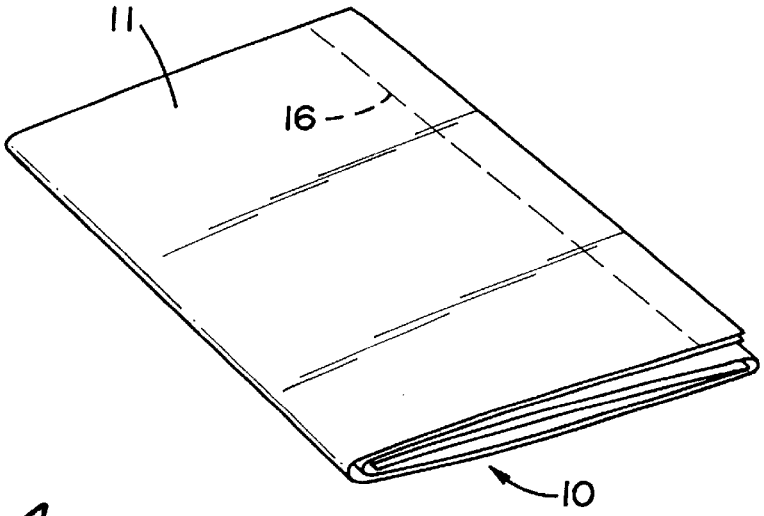
FIG. 4 is a top perspective view of the bag of the invention, illustrating how the bag is folded for storage and shipment after it has been filled with food to be cooked.

Referring more specifically to the drawings, a container in accordance with the invention is indicated generally at 10 and includes rectangularly shaped front and back panels 11 and 12, respectively, with the back panel being defined by two half panel sections 12*a* and 12*b*. The front and back panels are joined together along longitudinally extending fold lines 13 and 14 at their respective opposite side edges, and the half panel sections 12*a* and 12*b* terminate at their inner longitudinal edges in a pair of contiguous, laterally projecting flanges or panels 15*a* and 15*b* that define an extended fold-over flap 15 which projects from the center of the back panel 12 and has a width substantially equal to the width of one of the half panel sections 12*a* and 12*b*. This configuration, as seen best in FIGS. 2, 7–9 and 11, defines a tripartite structure having three substantially equal sections.

With reference to FIGS. 1, 3, 5 and 6, it will be observed that following manufacture of the bag, the fold-over flap 15 is folded over against one of the half panel sections 12*a* or 12*b* in overlying relationship thereto so that the bag is substantially flat for shipment and storage.

Opposite ends of the bag are closed and sealed by first closure means comprising adhesive bands 16 and 17, respectively, extending around an inner marginal end surface of the front and back panels 11 and 12*a*, 12*b*, and the panels 15*a* and 15*b* forming the fold-over flap.

The free side edges 15*c* and 15*d* of the fold-over flap panels 15*a* and 15*b* are also closed and sealed together by second closure means comprising an adhesive band 18 that extends along the confronting inner surfaces of the edges 15*c* and 15*d*.

Figure 10:
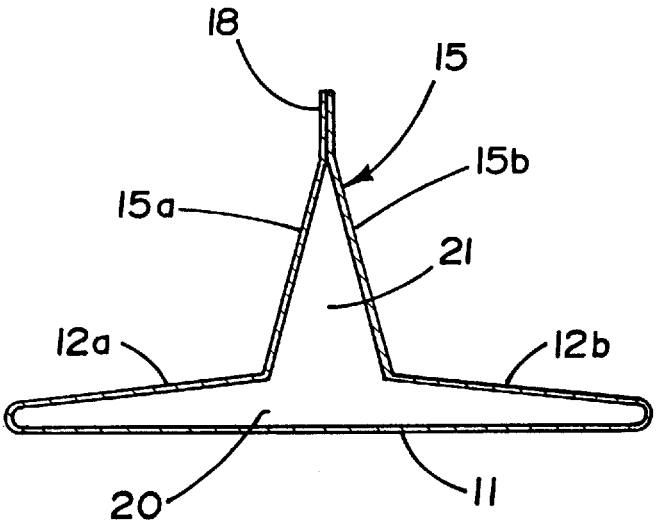
FIG. 10 is a somewhat schematic transverse sectional view of the bag of the invention, showing the relationship of the cooking and expansion chambers in a partially expanded condition.

The resulting enclosure forms a cooking chamber 20 between the front panel 11 and the back panel half sections 12*a* and 12*b*, and an expansion chamber 21 between the fold-over flap panels 15*a* and 15*b*. See FIG. 10.

A microwave susceptor 22 is provided in the front panel 11 for absorbing microwave energy and heating and cooking the food placed in the bag. The microwave susceptor extends over a substantial portion of the front panel 11 and thus the bottom of the cooking chamber 20, whereby the food to be cooked will naturally lie closely adjacent the susceptor due to the influence of gravity. Moreover, the expansion chamber 21 is located centrally above the cooking chamber, and opens vertically into the cooking chamber, whereby the heat energy is available to food in the expansion chamber. Further, any uncooked food, i.e., popcorn kernels, migrating into the expansion chamber 21 can fall by gravity back into the cooking chamber and into close proximity with the microwave susceptor.

With particular reference to FIGS. 1, 2, 8, 11, and 12, the longitudinal seam formed by the adhesive band 18 securing together the edges 15*c* and 15*d* is provided with suitable means for opening the bag along the outer edge of the fold-over flap 15. The means for opening the bag may comprise any suitable structure, and in the specific example illustrated and described herein, it comprises a tear string or tape 25 extending along the edge of the flap 15 closely adjacent an inner edge of the adhesive band 18, and a pair of slots or notches 26 and 27 extending a short distance inwardly from opposite ends of the flap 15 closely adjacent the tear string or tape 25 and spaced on the side thereof opposite the adhesive band. The notches 26 and 27 define starter tabs 28 and 29 at opposite ends of the longitudinal seam at the outer edge of the fold-over flap 15, which enable the secured-together edge portions to be easily removed, as shown in FIG. 8, thereby enabling the panel sections 15*a* and 15*b* to be spread apart to open the top surface of the bag and form a relatively large bowl-like container from which the cooked food, i.e. popcorn, can be eaten. See FIG. 9.

Figure 9:
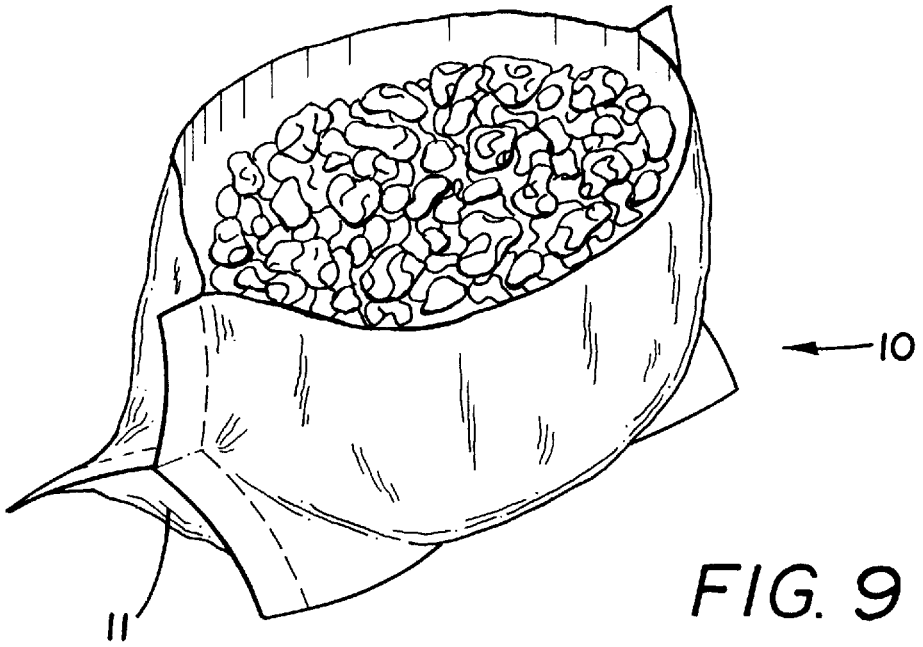
FIG. 9 is a top perspective view of the bag of FIG. 8, with the seam fully opened and the sides of the bag spread apart to expose the cooked food therein for consumption.

The tripartite configuration of the bag of the invention enables efficient cooking of the food confined therein, and provides a stable and convenient container from which the food can be directly eaten after it is cooked. This is best illustrated in FIGS. 7–9.

As illustrated in FIG. 13, the bag may be of two-ply construction, having an inner grease-proof ply 30 laminated to an outer grease-resistant ply 31, with the microwave susceptor 22 sandwiched therebetween. In a specific example of the invention, the inner ply 30 may comprise a 21# opaque grease-proof sheet adhesively bonded to the outer ply 31, which may comprise a 25# bleached, machine-finished, grease-resistant kraft paper. The microwave susceptor 22 may comprise a metalized polyester susceptor film patch.

The strips of adhesive 16, 17 and 18 may comprise any suitable commercially available material and may be thermosetting or thermoplastic, so long as the end seals 16 and 17 remain intact and do not open or vent during or after cooking of the food. The adhesive strip or band 18, on the other hand, should partially open to achieve controlled venting of steam from the interior of the bag during cooking of the food.

Figure 11:
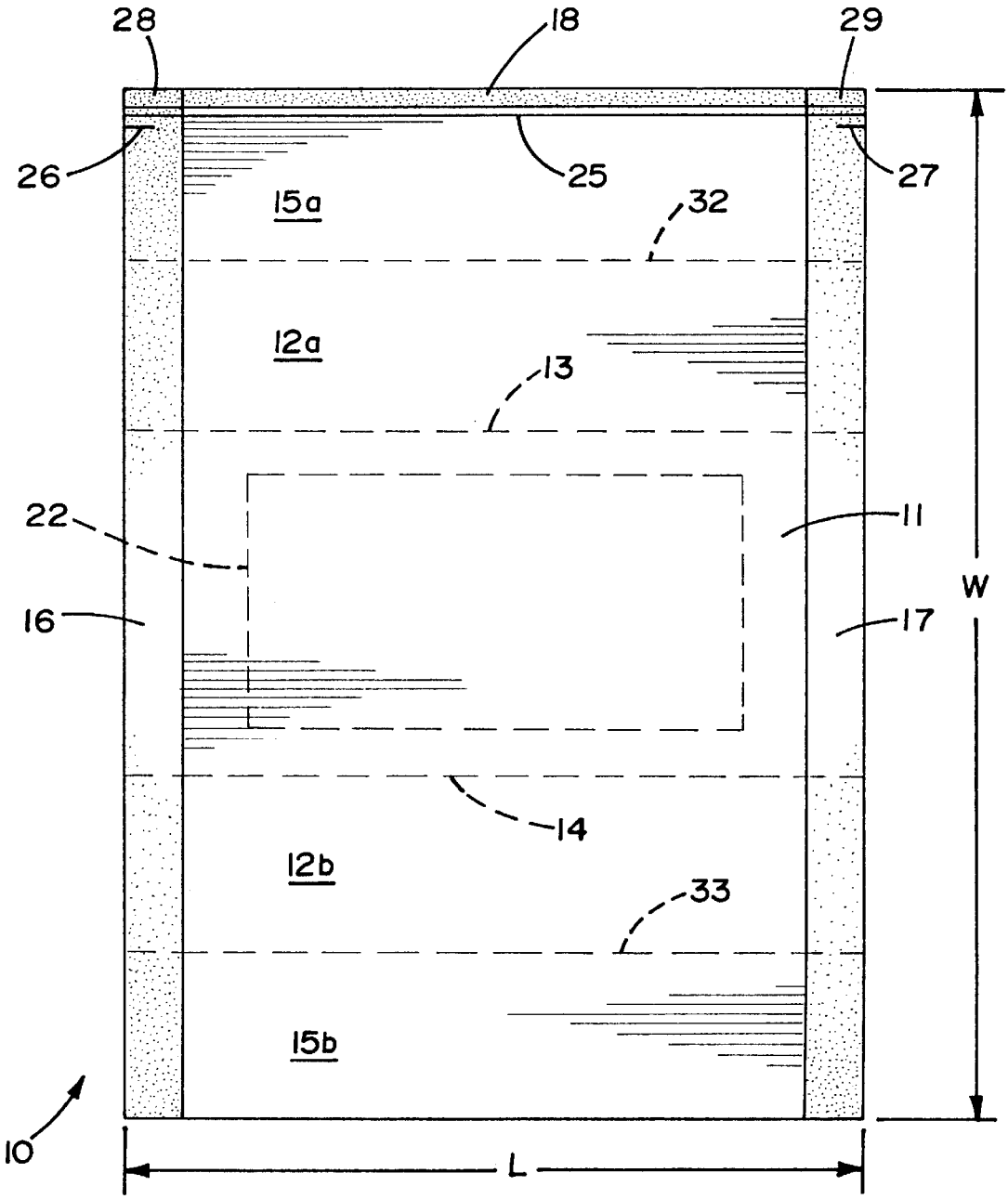
FIG. 11 is a top plan view of the blank from which the bag of the invention is constructed, showing the placement of adhesive strips, microwave susceptor patch and fold lines.

During manufacture of the bag, a suitable single ply or multiple ply lamination is formed into a rectangular blank that, in one specific construction, has a width W of approximately 19" and a length L of approximately 12". With reference to FIG. 11, it can be seen that the fold lines 13 and 14 subdivide the blank into three substantially equal panels, including the back panel 11 in which the microwave susceptor 22 is provided, and the panel sections 12*a*, 15*a* and 12*b*, 15*b*, respectively. It will further be observed that the panels 12*a* and 15*a* and panels 12*b* and 15*b* are substantially equal in width. Consequently, when the panels are folded together to construct the bag, the resulting bag will have a width of about six and three-eighths inches and a length of about twelve inches, with the fold-over flap on the back panel of the bag extending approximately three and one-half inches from the longitudinal center of the bag to one of the side edges when the flap is folded flat against the back panel.

While the blank used in forming the bag is in its pre-folded condition, suitable graphics may be applied to the bag, as desired, and the strips of adhesive 16, 17, and 18 are applied on edge portions of the inner ply. The blank is then folded about fold lines 13 and 14 and 32, 33 into the shape illustrated in FIG. 12. One end of the bag is then pressed to close and seal the adhesive strip 17 to close that end of the bag. Similarly, pressure is applied along the outer edge of the fold-over flap 15 to close and seal the strip of adhesive 18. The flap 15 is then folded over against the back panel as seen in FIG. 1, for example. The bag is shipped in this flattened or collapsed condition to a suitable facility for filling the bag with food to be cooked. Prior to placing the food in the bag, approximately one third of the length of the bag at the closed bottom end (see FIG. 14) is folded into overlying relationship with the central body portion of the bag. Uncooked food may then be introduced through the open top of the bag on suitable equipment for this purpose. Following filling of the bag, the top end is closed and sealed and then folded over to retain the food in the central portion of the bag adjacent the heat enhancer.

Figure 5:
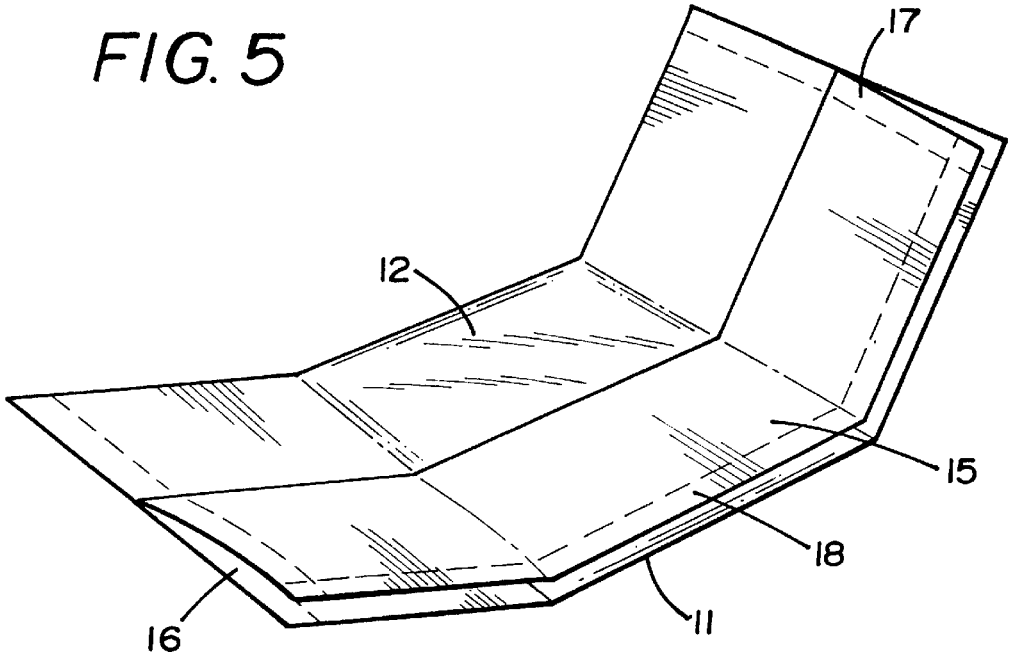
FIG. 5 is a top perspective view of the bag of FIG. 4, showing it unfolded into position for cooking the food.
Figure 6:
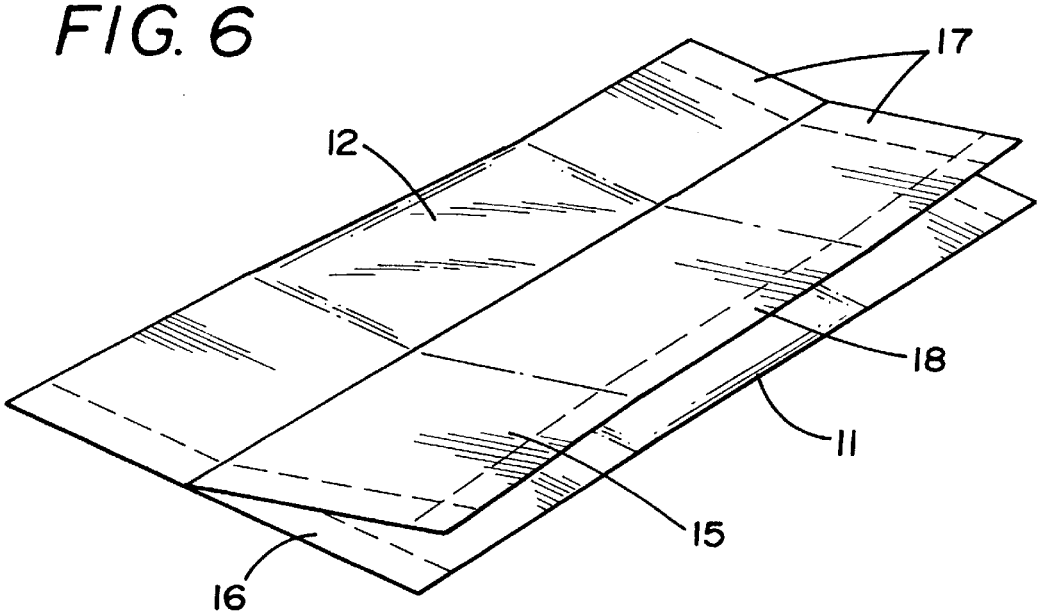
FIG. 6 is a top perspective view of the bag of FIG. 5, showing the bag lying substantially flat in the position it would typically assume at the beginning of a cooking cycle.

When it is desired to cook the food in the bag, it is unfolded to the position shown in FIG. 5 and placed face down on the floor of a microwave oven. As the food cooks and expands, it begins to fill the cooking chamber 20 and the expansion chamber 21, with the fold-over flap 15 standing in an upright position as shown in FIG. 7. When the food has finished cooking, the bag is fully expanded to the condition shown in FIG. 8, and one of the starter tabs 28 or 29 may be grasped to tear away the sealed edge of the fold-over flap 15 to open the top surface of the bag and expose the cooked food. The resulting structure is very stable when supported on a table or a person's lap, and may be conveniently used as a container from which to serve the food.

Although a specific type of means for opening the longitudinal seam at the edge of the fold-over flap has been illustrated and described, it should be understood that any suitable means may be used, such as a perforation line extending along the seam 18, or reinforced tabs extending outwardly from the edges 15*c* and 15*d*, which may be grasped and pulled apart to separate or open the seam 18.

Following cooking of the food, the bag will be hot but it can be conveniently taken from the microwave oven by carefully grasping one of the extended fins defined by the glue seams 16 or 17 at either end closure of the bag. The fins defined by these glue seams may also be used to assist in holding the container while the edge seam 18 is opened to gain access to the cooked food.

Because neither end seam of the bag is used for venting during cooking of the food, hot oils do not seep out of the container. This eliminates oil contamination on the floor of the oven or on the hands or clothing of the person using the bag.

Moreover, food can be eaten directly from the bag after it is cooked, without the need to hold the bag in an upright position or to empty the food into another container. The filled bag of the invention will sit up conveniently on a table or in the user's lap, freeing the user's hands and enabling the cooked food, i.e. popcorn, to be eaten directly from the bag.

While particular embodiments of the invention have been illustrated and described in detail herein, it should be understood that various changes and modifications may be made to the invention without departing from the spirit and intent of the invention as defined by the scope of the appended claims.

What is claimed is:

1. A gusset-free microwavable popcorn bag for receiving, storing and popping a quantity of popcorn, and for serving the popcorn after it is popped, said bag comprising:

a folded rectangular blank of paper having opposite ends folded inwardly toward one another along a first pair of parallel fold lines spaced inwardly approximately one-third the distance from said opposite ends to define a front panel and a pair of inwardly folded panels, said inwardly folded panels being folded outwardly along a second pair of parallel fold lines spaced equidistantly between the respective first fold lines and the associated free ends of the inwardly folded panels, defining a pair of half-panel sections that form a back panel, and panel sections that extend in generally parallel coextensive relationship with one another to form a fold-over flap that extends from a longitudinal centerline of the back panel, said first pair of fold lines defining opposite side edges of the bag and the second pair of fold lines lying contiguous to one another along the longitudinal centerline of the bag, said half-panel sections each having a width substantially one-half the width of the front panel and a length the same as the length of the front panel, said front and back panels having opposite side edges and opposite ends, and closed and sealed together at said opposite ends, defining a cooking chamber between the front and back panels;

said fold-over flap having opposite ends closed and sealed together and defining an expansion chamber that is in communication with said cooking chamber and being adapted to lie flat against one half-panel section of the back panel during shipping and storage and being coextensive in length and width with the half-panel section, said fold-over flap having a free edge adapted to project laterally outwardly from the back panel as the popcorn is popped in the cooking chamber and expands into the expansion chamber; and means for opening said bag along an outer free edge of the fold-over flap to gain access to the contents of the bag, whereby the front panel of the bag may be placed on the floor of a microwave oven to pop the popcorn in the bag, the fold-over flap then opened along an outer edge to open the bag to gain access to the popcorn, and the popcorn eaten directly from the bag.

2. A microwavable bag as claimed in claim 1, wherein:

the opposite ends of the front and back panels and the fold-over flap are secured and sealed together by a band of adhesive placed between the respective panels, forming permanent closure seams.

3. A microwavable bag as claimed in claim 2, wherein:

outer free edges of the panels that form the fold-over flap are secured and sealed together by a band of adhesive placed along confronting surface portions of the edges, forming an openable closure seam that at least partially opens during popping of the popcorn to obtain controlled venting from the interior of the bag, and which may be readily fully opened to gain access to the popped popcorn.

4. A microwavable container as claimed in claim 3, wherein:

the bag is made from a single sheet of material folded and secured together to define the front and back panels and the fold-over flap.

5. A microwavable container as claimed in claim 4, wherein:

the sheet of material comprises a lamination of paper sheets.

6. A microwavable container as claimed in claim 5, wherein:

a microwave susceptor patch is provided in said front panel to absorb microwave energy during microwave cooking to heat and cook the food in the container.

7. A microwavable bag as claimed in claim 1, wherein:

the bag is made from a single sheet of material folded and secured together to define the front and back panels and the fold-over flap.

8. A microwavable bag as claimed in claim 7, wherein:

the sheet of material comprises a lamination of paper sheets.

9. A microwavable bag as claimed in claim 1, wherein:

a microwave susceptor patch is provided in said front panel to absorb microwave energy during microwave cooking to heat and pop the popcorn in the bag.

10. A gusset-free microwavable bag for popping popcorn in a microwave oven and serving as a container from which to eat the popped popcorn, comprising;

front and back rectangularly shaped panels having opposite side edges and opposite ends, defining a cooking chamber therebetween;

a rectangularly shaped fold-over flap projecting from the back panel, defining an expansion chamber that is in communication with the cooking chamber, whereby as the popcorn expands during a popping cycle, the expansion chamber and cooking chamber open up into a single interior volume occupied by the popped popcorn, said fold-over flap adapted to lie flat against and within the boundaries of the back panel during shipping and storage of the bag, and to expand into an upright position projecting from the back panel as the popcorn is popped; and an outer free edge on said fold-over flap being closed by an openable seam that at least partially opens during popping of the popcorn to obtain controlled venting from the interior of the bag, and which may be readily fully opened to gain access to the popped popcorn at the conclusion of a popping cycle, said front panel defining a relatively wide supporting surface for stably supporting the bag in position with the openable edge of the fold-over flap oriented upwardly, and said fold-over flap being spreadable after the outer edge thereof is opened to define a wide access opening for convenience for eating the popcorn directly from the bag.

* * * * *